US012220047B2

(12) United States Patent
Tam et al.

(10) Patent No.: US 12,220,047 B2
(45) Date of Patent: Feb. 11, 2025

(54) COLD TEMPERATURE HAIR BRUSH

(71) Applicant: CONAIR CORPORATION, Stamford, CT (US)

(72) Inventors: Denise Tam, Pierrefonds (CA); Vito James Carlucci, Stratford, CT (US); Karen Lynne Baudouin, Parkland, FL (US)

(73) Assignee: Conair LLC, Stamford, CT (US)

( * ) Notice: Subject to any disclaimer, the term of this patent is extended or adjusted under 35 U.S.C. 154(b) by 439 days.

(21) Appl. No.: 16/682,318

(22) Filed: Nov. 13, 2019

(65) Prior Publication Data

US 2021/0137258 A1 May 13, 2021

(51) Int. Cl.
*A46B 15/00* (2006.01)
*A46B 9/02* (2006.01)

(52) U.S. Cl.
CPC ..... *A46B 15/0022* (2013.01); *A46B 9/023* (2013.01); *A46B 15/0051* (2013.01); *A46B 2200/104* (2013.01)

(58) Field of Classification Search
CPC ..... A45D 1/04; A45D 2001/008; A46B 15/0051; A46B 15/0022
See application file for complete search history.

(56) References Cited

U.S. PATENT DOCUMENTS

| | | | |
|---|---|---|---|
| 4,011,104 | A | 3/1977 | Basiulis |
| 6,354,305 | B1 | 3/2002 | Janouch et al. |
| 7,989,734 | B2 | 8/2011 | Lee |
| 8,347,897 | B2 | 1/2013 | Benest et al. |
| D939,219 | S | 12/2021 | Hinds |
| 2011/0056509 | A1 | 3/2011 | Benest et al. |
| 2015/0047669 | A1 | 2/2015 | Huang |
| 2017/0006988 | A1 | 1/2017 | Wong |
| 2017/0127784 | A1 | 5/2017 | Rees-Jones et al. |
| 2018/0185236 | A1 | 7/2018 | Levi |
| 2018/0271247 | A1 | 9/2018 | Marston et al. |
| 2018/0295980 | A1 | 10/2018 | Boersma et al. |

(Continued)

FOREIGN PATENT DOCUMENTS

| | | | |
|---|---|---|---|
| CN | 104207453 | A | 12/2014 |
| EP | 3 355 742 | B1 | 8/2021 |
| GB | 2459507 | B | 12/2010 |

(Continued)

OTHER PUBLICATIONS

International Search Report dated Dec. 14, 2020 from corresponding International Application No. PCT/US2020/053919, 2 pages.

(Continued)

*Primary Examiner* — Nicholas D Lucchesi
*Assistant Examiner* — Jennifer Gill
(74) *Attorney, Agent, or Firm* — Ruggiero McAllister & McMahon LLC

(57) ABSTRACT

A hair brush includes a housing and a cooling device in the housing. A comb is in thermally conductive contact with the cooling device and adapted to be cooled when thermal energy in the form of heat is transferred by the cooling device in a direction away from the comb. The comb has a hair contacting surface. The hair contacting surface comprises one or more teeth adapted to directly engage a user's hair.

11 Claims, 8 Drawing Sheets

(56) References Cited

U.S. PATENT DOCUMENTS

| | | | | |
|---|---|---|---|---|
| 2021/0204685 | A1* | 7/2021 | Christensen | A46B 17/065 |
| 2023/0020204 | A1 | 1/2023 | Yin et al. | |

FOREIGN PATENT DOCUMENTS

| | | | |
|---|---|---|---|
| GB | 2543034 | * | 4/2017 |
| KR | 10-0998166 | B1 | 11/2010 |
| KR | 10-2011-0135247 | * | 12/2011 |
| KR | 10-1102925 | B1 | 1/2012 |
| KR | 10-2019-0077278 | A | 7/2019 |
| WO | 2008062293 | A1 | 5/2008 |
| WO | 2009/096289 | A1 | 8/2009 |
| WO | 2017/105123 | A1 | 6/2017 |
| WO | 2018138661 | A1 | 8/2018 |

OTHER PUBLICATIONS

Written Opinion dated Dec. 14, 2020 from corresponding International Application No. PCT/US2020/053919, 4 pages.
Extended European Search Report dated Dec. 12, 2023 from corresponding European Patent Application No. 20886846.3, 12 pages.
Argentine Search Report dated Mar. 18, 2024 from corresponding Argentine Patent Application No. P200103113, 10 pages.

* cited by examiner

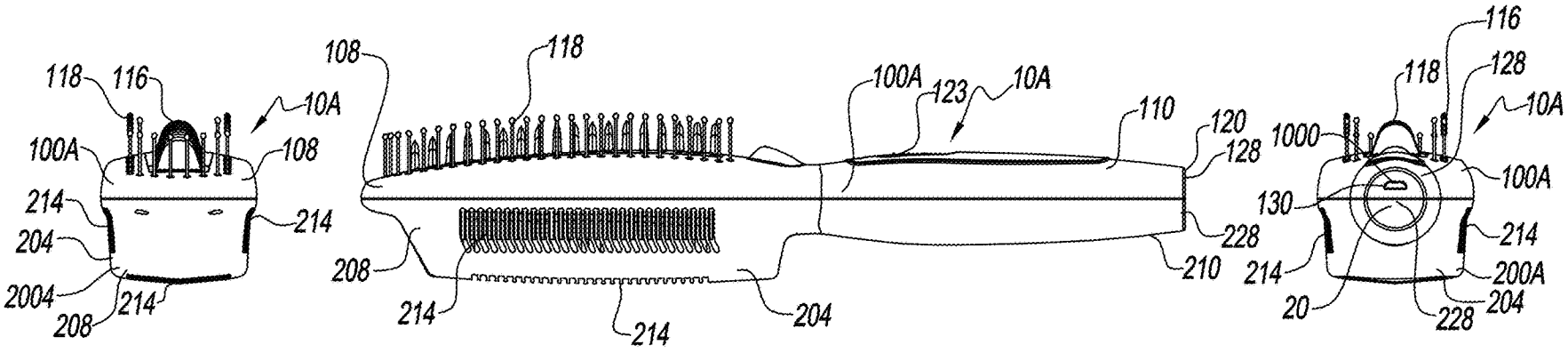
FIG. 16
FIG. 14
FIG. 17
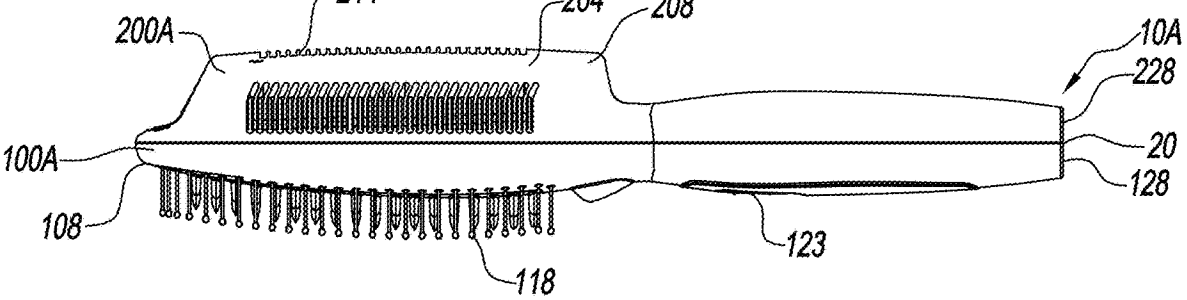
FIG. 15

COLD TEMPERATURE HAIR BRUSH

BACKGROUND OF THE DISCLOSURE

1. Field of the Disclosure

The present disclosure is directed to a hair brush. More particularly, the present disclosure relates to a hair brush that is cooled.

2. Description of the Related Art

The effects of cold temperature on hair are generally known: cold application, such as cold water, closes the hair cuticles, thereby, trapping moisture and reducing frizziness and dryness, resulting in silkier, smoother hair. Heat is known to strip away hair oils and leave the cuticles open, resulting in dry hair and frizzy hair.

Accordingly, there is a need for an implement to treat hair that provides the advantages of cold temperature applied to hair and avoids the disadvantages of heat applied to hair.

SUMMARY

The present disclosure provides a hair brush that cools hair to provide the advantages of cold temperatures applied to hair, namely, to close the hair cuticles, thereby, trapping moisture and reducing frizziness and dryness, resulting in silkier, smoother hair, and, avoids the disadvantages of heat applied to hair, namely, stripping away hair oils and leaving the cuticles open, resulting in dry hair and frizzy hair.

The present disclosure provides a hair brush that includes a housing and a cooling device in the housing. A comb is in thermally conductive contact with the cooling device and adapted to be cooled when thermal energy in the form of heat is transferred by the cooling device in a direction away from the comb.

The present disclosure further provides that the comb of the hair brush has a hair contacting surface that comprises one or more teeth adapted to directly engage a user's hair.

The above and other objects, features, and advantages of the present disclosure will be apparent and understood by those skilled in the art from the following detailed description, drawings, and accompanying claims. As shown throughout the drawings, like reference numerals designate like or corresponding parts.

BRIEF DESCRIPTION OF THE DRAWINGS

FIG. 14 is a side view of the hair brush of FIG. 12.

FIG. 15 is a side view of the hair brush of FIG. 12 rotated 180 degrees from FIG. 14.

FIG. 16 is a front view of the hair brush of FIG. 12.

FIG. 17 is a rear view of the hair brush of FIG. 12.

DETAILED DESCRIPTION OF THE DISCLOSURE

Figure 1:
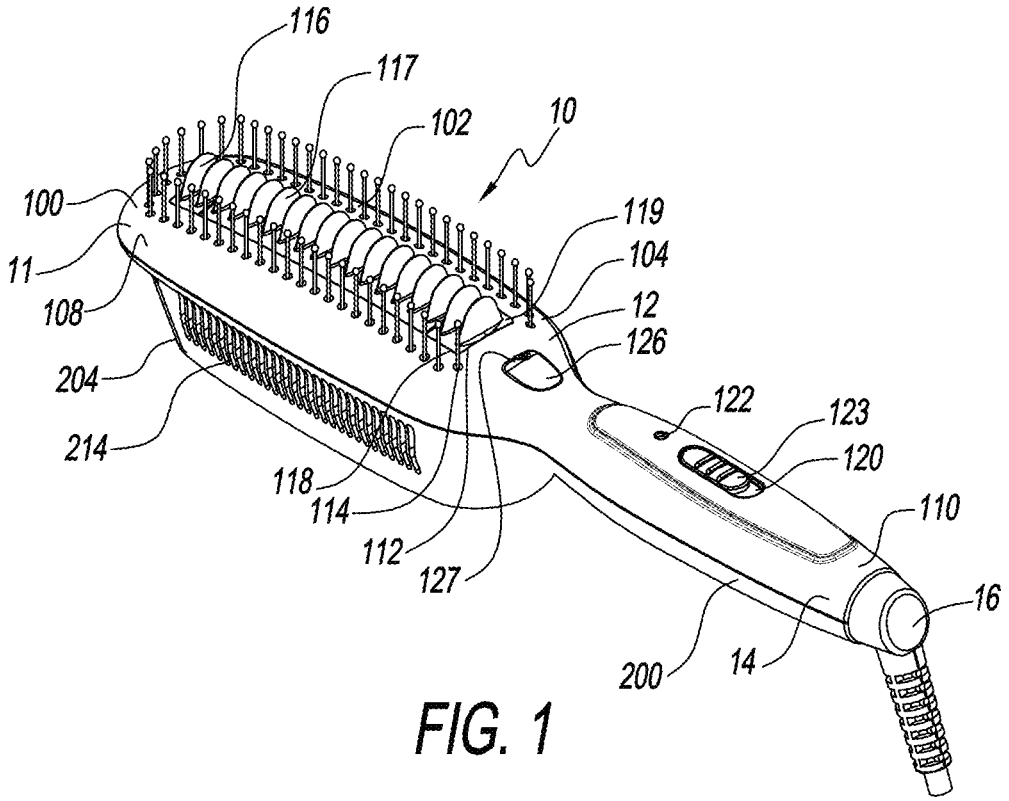
FIG. 1 is a top perspective view of a hair brush according to the present disclosure having a plug.

A hair brush 10 according to the present disclosure is shown in FIGS. 1-7. Hair brush 10 has a cool side 102. Brushing cool side 102 through a user's hair can provide advantages of cold temperatures applied to hair, namely, to close the hair cuticles, thereby, trapping moisture and reducing frizziness and dryness, resulting in silkier, smoother hair.

Hair brush 10 has a housing 11. Housing 11 has an upper housing 100 and a lower housing 200. Upper housing 100 and lower housing 200 are die cast metal. Upper housing 100 forms an upper brush portion 108 and an upper handle portion 110. Upper brush portion 108 has a center opening 112 and holes 114 that surround center opening 112.

Comb 116 has teeth 117 that extend through center opening 112. Teeth 117 are connected to a teeth support 119. Comb 116 is metallic or any suitable material with thermal conductivity properties.

Bristles 118 extend through holes 114. Bristles 118 can alternatively be teeth. Bristles 118 may or may not be thermally conductive. Bristles 118 can include 90 cool to-the-touch metal or non-metal bristles to help align the hair and hold it against hair brush 10.

Figure 8:
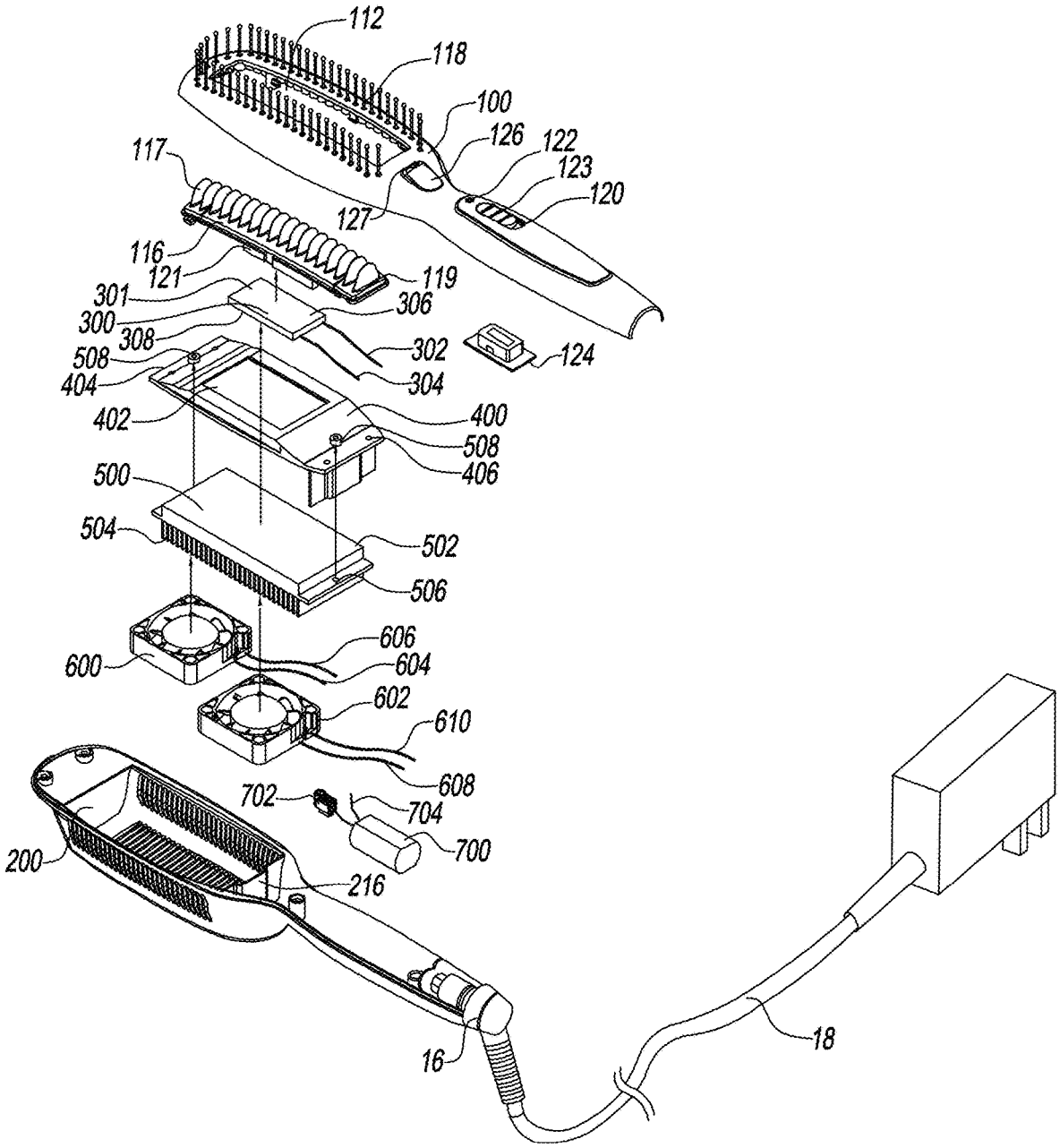
FIG. 8 is an exploded top perspective view of the hair brush of FIG. 1.

Upper handle portion 110 has an opening 120 and a hole 122. Opening 120 receives a user engageable member 123 that moves an on/off switch 124 (FIG. 8). On/off switch 124 is, for example, a dual voltage switch. Hole 122 receives a power indicator, for example, a light emitting diode ("LED"). Upper handle portion 110 has a cavity 126. Cavity 126 has an opening 127 through upper handle portion 110. Cavity 126 is an open space beneath the surface of upper handle portion 110. Opening 127 connects the cavity 126 to the surrounding air outside of the handle portion 110.

Figure 2:
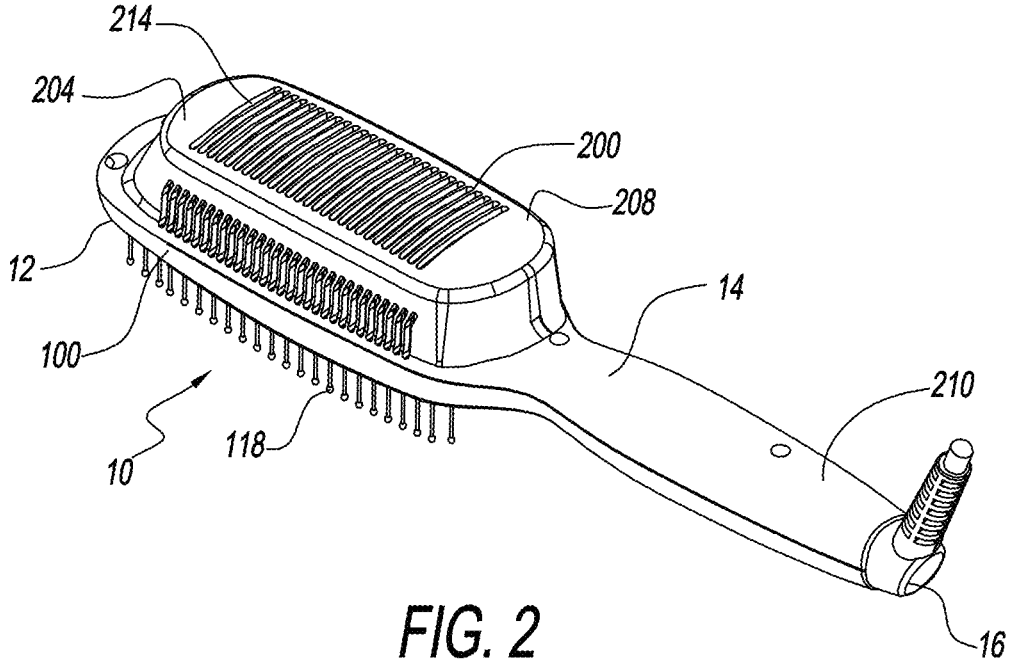
FIG. 2 is a bottom perspective view of the hair brush of FIG. 1.
Figure 7:
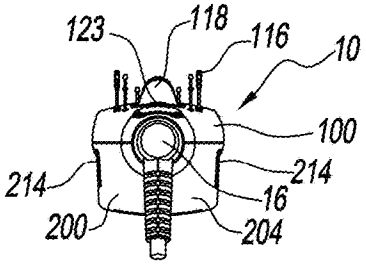
FIG. 7 is a rear view of the hair brush of FIG. 1.
Figure 3:
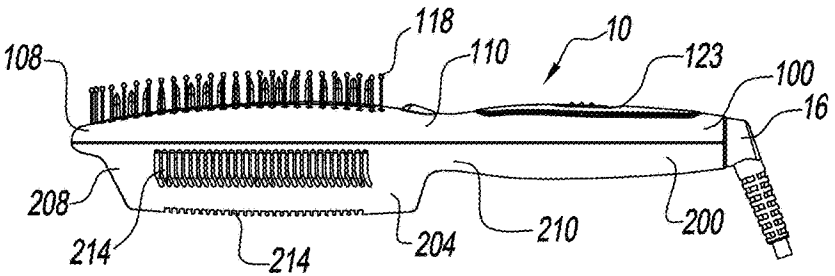
FIG. 3 is a side view of the hair brush of FIG. 1.
Figure 6:
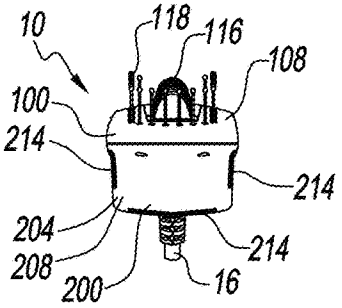
FIG. 6 is a front view of the hair brush of FIG. 1.
Figure 4:
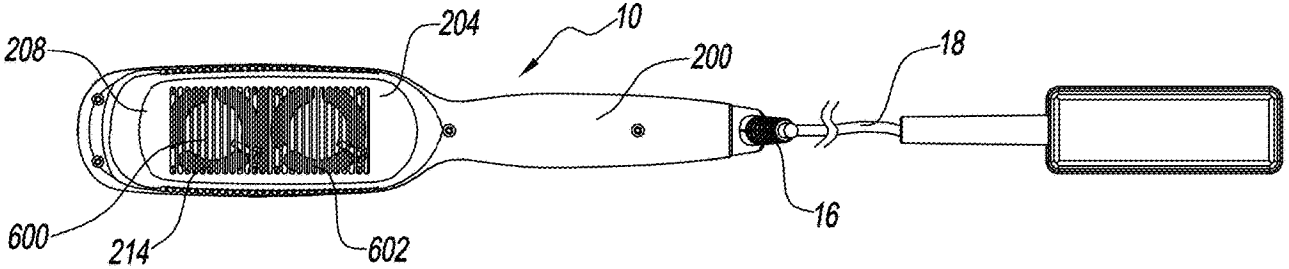
FIG. 4 is a bottom view of the hair brush of FIG. 1 attached to a power cord.
Figure 5:
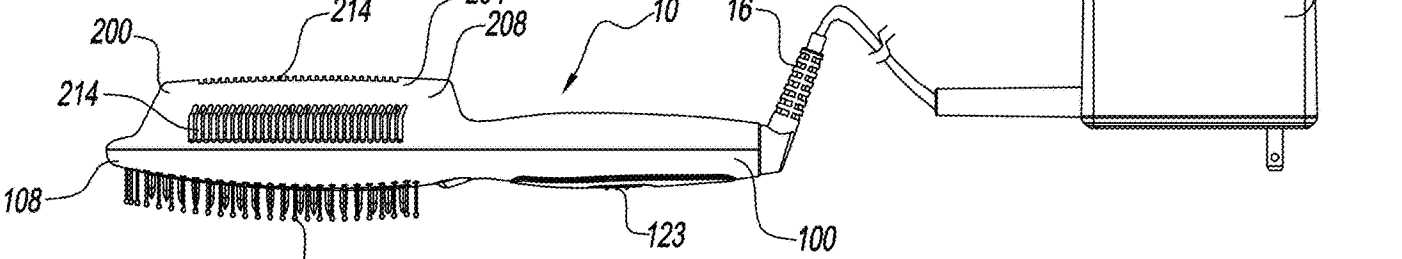
FIG. 5 is a side view of FIG. 4.

Referring to FIG. 2, hair brush 10 has lower housing 200. Lower housing 200 forms a lower brush portion 208 and a lower handle portion 210. Lower brush portion 208 connects to upper brush portion 108 to form a brush portion 12 that can brush through a user's hair. Lower brush portion 208 has vent openings 214. Lower handle portion 210 connects to upper handle portion 110 to form a handle 14 that can be gripped by the user. Lower handle portion 210 and upper handle portion 110 are connected to a swivel 16 that receives a power cord 18 as shown in FIGS. 4 and 5.

Referring to FIG. 8, lower housing 200 is connected to upper housing 100 to house a portion of comb 116, a portion of bristles 18, a portion of user engageable member 123, on/off switch 124, a cooling device 300, a heater enclosure 400, a heat sink 500 positioned below heater enclosure 400, fan assemblies 600, 602 and an ionizer 700.

Cooling device 300 has a thermoelectric cell 301 that is a solid-state, active heat pump which transfers heat from one side of cooling device 300, namely, a cool side 306, to the other side, namely, a hot side 308, with the consumption of electrical energy. By controlling a direction of a current in cooling device 300, cool side 102 is created on a brush side 104 and a hot side 204 is created opposite brush side 104, as shown in FIG. 1. Cooling device 300 has wires 302, 304.

Heater enclosure 400 can be metallic or a non-thermally conductive material with enough heat resistance that it does not retain heat and, therefore, does not stall the movement of heat that is being removed and directed to the heat sink 500. Heater enclosure 400 has an opening 402 through which heat is moved or transferred, between thermoelectric cell 301 and heat sink 500. Opening 402 is sized to fit cooling device 300 therein. Heater enclosure 400 has an upper connector 404 and a lower connector 406.

Heat sink 500 is a block that is flat on top 502 and has fins 504 on the bottom. Fins 502 dissipate heat. Heat sink 500 can be connected to heater enclosure 400 by flanges 506 and connectors 508 on opposite sides of heat sink 500.

Heater enclosure 400 can be of any structurally rigid material. Heat sink 500 is an aluminum heat sink or other suitable materials which, like aluminum, have good thermal conductivity.

Fan assemblies 600, 602 are brushless motor fans, for example, two small, quiet brushless motor fans. Fan assemblies 600, 602 are of the type commonly used for cooling small electronic devices. Fan assembly 600 has wires 604, 606 and fan assembly 602 has wires 608, 610. Fan assemblies 600, 602 can be "Max Life" Brushless Motors fans that dissipate heat from thermoelectric cell 301 of cooling device 300 for maximum cooling performance.

Ionizer 700 comprises a generally known construction of, essentially, a needle that receives voltage and emits ions into the surrounding air. The ions travel out of opening 127 through upper handle portion 110. Ionizer 700 is a negative ion high voltage generator with many carbon fiber filaments for an ion emitter to increase a negative ion output as is known in the art. Ionizer 700 has an emitter 702 and a wire 704.

Lower housing 200 has a rear interior wall 216.

Figure 10:
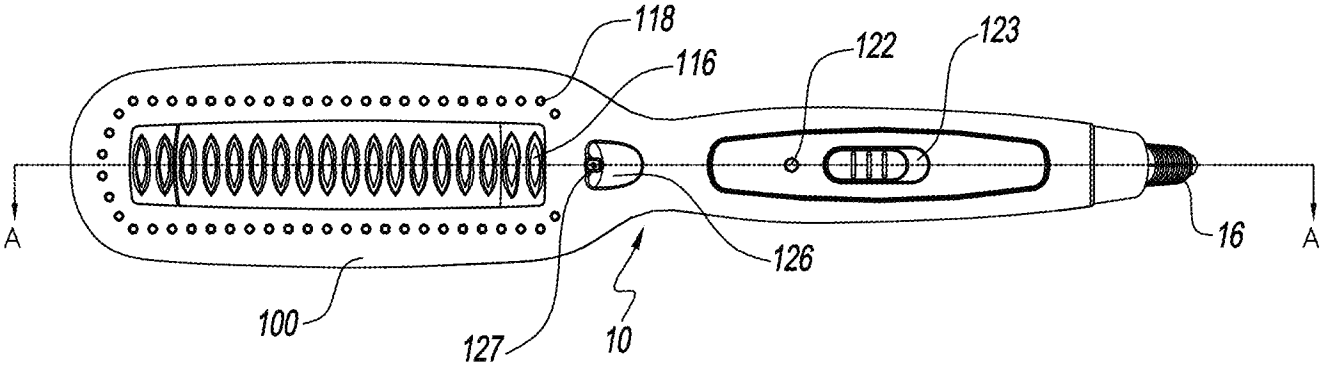
FIG. 10 is a top view of the hair brush of FIG. 1.
Figure 11:
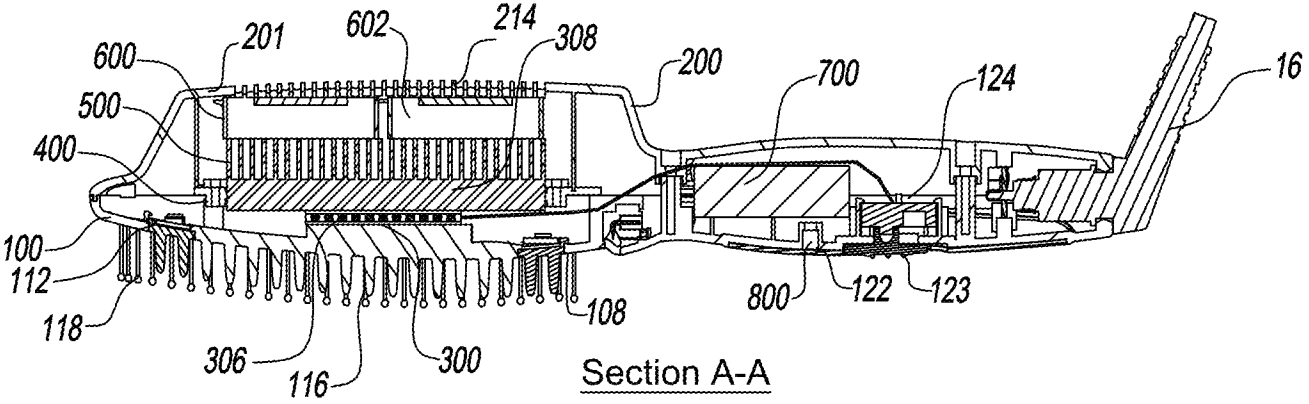
FIG. 11 is a side cross-sectional view of the hair brush of FIG. 1 taken along line A-A of FIG. 10.
Figure 12:
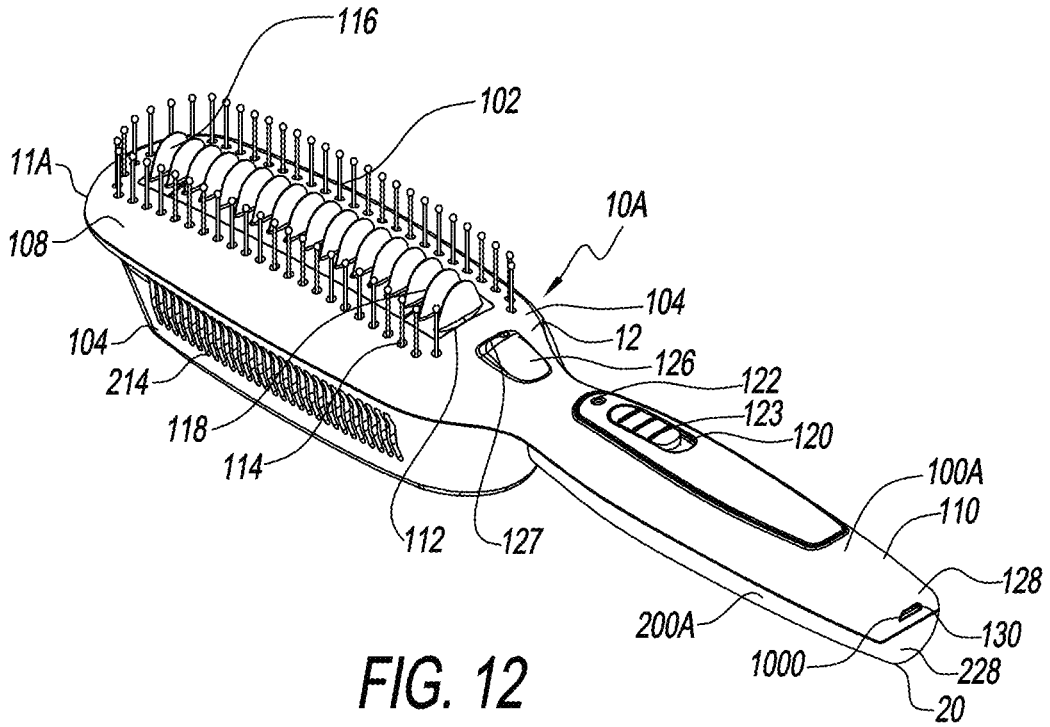
FIG. 12 is a top perspective view of a hair brush according to the present disclosure having a battery.
Figure 13:
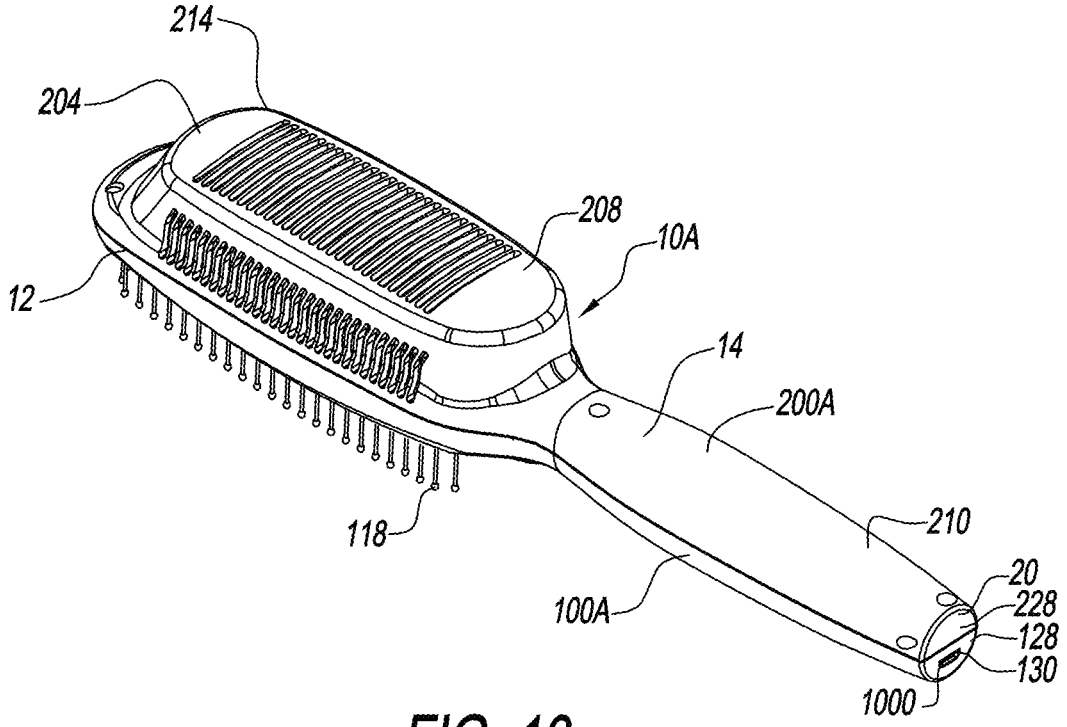
FIG. 13 is a bottom perspective view of the hair brush of FIG. 12.

Referring to FIGS. 10 and 11, comb 116 has teeth 117 that extend through center opening 112. Teeth support 119 is sized larger than center opening 108 to maintain a portion of teeth support 119 inside upper housing 100. Teeth support 119 has protrusion 121 that contacts cooling device 300. Wires 302, 304 of cooling device 300 connect to on/off switch 124. Cooling device 300 is positioned in opening 402 in heater enclosure 400. Heater enclosure 400 connects to or abuts upper housing 100 by upper connector 404 and heater enclosure 400 connects to or abuts rear interior wall 216 of lower enclosure 200 by lower connector 406. Heater enclosure 400 maintains a position of cooling device 300 between protrusion 121 of comb 116 and heat sink 500. Heat sink 500 contacts cooling device 300 on hot side 308. Fan assemblies 600, 602 contact heat sink 500 on a side opposite a side of heat sink 500 that contacts cooling device 300. Wires 604, 606, 608, 610 of fan assemblies 600, 602 connect to on/off switch 124. Fan assemblies 600, 602 abut vents 214 through a back wall 201 of lower housing 200 on a side opposite a side of fan assemblies 600, 602 that contact heat sink 500. Ionizer 700 is positioned between lower handle portion 210 and upper handle portion 110. Wire 704 of ionizer 700 is connected to on/off switch 124. Emitter 702 of ionizer is positioned in cavity 126 in upper housing 100. Hole 122 receives the power indicator, for example, LED 800 that has a wire connecting to switch 124. On/off switch 124 connects to power cord 18 that is in swivel 16, for example, by wires of on/off switch 124 that connect to wires of power cord 18.

During operation, on/off switch 124 is moved from an off position where electrical current is prevented from conducting through on/off switch 124 to an on position where electrical current is conducted through on/off switch 124 by the user moving user engageable member 123. Power cord 18 supplies electrical current to on/off switch 124 from a power supply, for example, an electrical outlet. Electrical current is supplied to LED 800 that has a wire connecting to switch 124 illuminating LED 800. Illuminating LED 800 indicates that power is being supplied to hair brush 10 so that the user can determine that hair brush 10 is on.

Electrical current is supplied to cooling device 300 so that thermoelectric coolers of cooling device 300 operate by the Peltier effect (which also goes by the more general name thermoelectric effect). Cooling device 300 device has two sides, and when a DC electric current flows through cooling device, the DC electric current brings heat from cool side 306 to hot side 308, so that cool side 306 gets cooler while hot side 308 gets hotter. Hot side 308 is attached to heat sink 500 so that hot side 308 remains at ambient temperature, while cool side 306 goes below room temperature. In some applications, multiple cooling devices 300 can be cascaded together for lower temperature. Cool side 306 contacts protrusion 121 of comb 116 to cool comb 116 that is applied in direct contact to the user's hair. Cool side 306 or comb 116 that is cooled by cool side 306 can also contact bristles 118 and/or upper housing 100 that can also be applied in direct contact to the user's hair. Cool side 306 can reach 0 degrees Celsius. Hot side 308 conducts heat to heat sink 500.

Heat sink 500 can be an aluminum heat sink that draws heat away from hot side 308 of cooling device 300 from upper housing 100 toward lower housing 200. Heat sink 500 can be other suitable materials which, like aluminum, have good thermal conductivity. Fan assemblies 600, 602 assist in moving heat away from heat sink 500 rapidly and lower housing 200 is vented with vents 214 to release the heat into the ambient air. To maximize cooling, fan assemblies 600, 602 are two small, quiet brushless motor fans to remove the heat on hot side 308. Thin weights can be added to the brushless motor fans.

Electrical current is supplied to ionizer 700 to emit ions from hair brush 10 through opening 127 in cavity 126. Ionizer 700 has an ion generator used to reduce static.

A vibration motor can be included to give hair brush 10 a vibration mode. Hair brush 10 can include a vibration motor having an eccentric or off-center weight on a rotating shaft as are generally known in the art. The vibrating mode massages a user's scalp.

When the user desires to stop operating hair brush 10, on/off switch 124 is moved from the on position where electrical current is conducted through on/off switch 124 to the off position where electrical current is prevented from conducting through on/off switch 124 by the user moving user engageable member 123.

Hair brush 10 can have contact surfaces that are coated with various coatings known to impart smoothing benefits including, but not limited to, coatings containing particles of titanium, ceramics, silver and other elements, minerals and substances.

Figure 9:
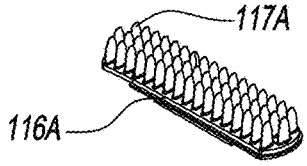
FIG. 9 is top perspective view of a modified comb for the hair brush of FIG. 1.

Referring to FIG. 9, comb 116A having teeth 117A is shown. Comb 116 can be modified to comb 116A to include more teeth 117A. Alternatively, comb 116 may be interchangeable with comb 116A so that either comb 116 is connected to upper housing 100 or comb 116A is connected to upper housing 100.

FIGS. 12-17, a hair brush 10A is shown. Hair brush 10A is the same as hair brush 10 except hair brush 10A replaces swivel 16 and a power cord 18 with a battery 900, and housing 11 having upper housing 100 and lower housing 200 are modified to housing 11A having upper housing 100A and lower housing 200A to accommodate battery 900. Accordingly, the same reference numerals are used for hair brush 10A as hair brush 10 for like components.

Upper housing 100A has a back wall 128. Back wall 128 has an opening 130 to access an outlet 1000. Upper housing 100A also positions opening 120, hole 122, user engageable member 123, and on/off switch 124 closer to upper brush portion 108 than upper housing 100.

Lower housing 200A has a lower back wall 228. Lower back wall 228 and upper back wall 128 connect to form an end of hair brush 10A.

Ionizer 700 can be modified to be smaller as shown by ionizer 700A of hair brush 10A to accommodate battery 900.

Figure 18:
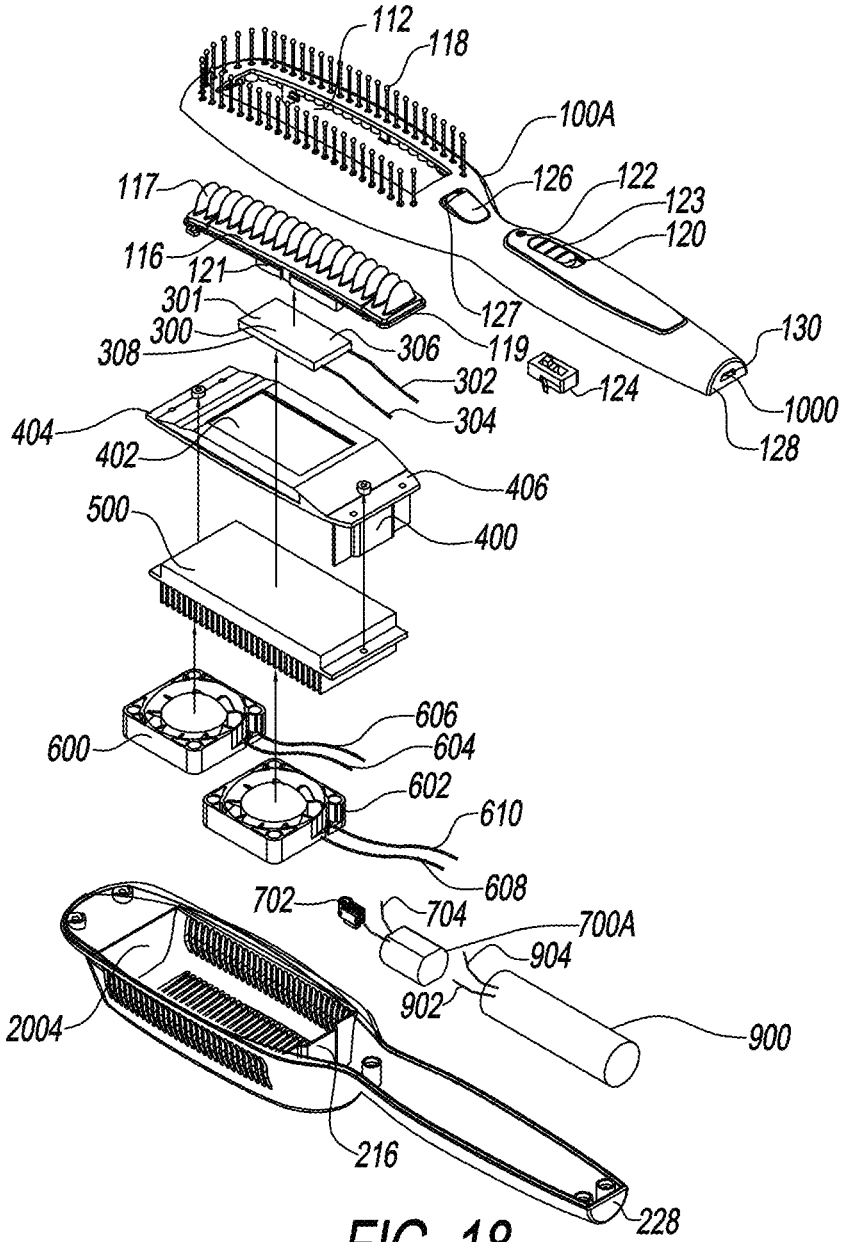
FIG. 18 is an exploded top perspective view of the hair brush of FIG. 12.
Figure 19:
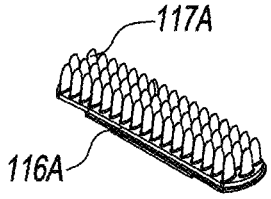
FIG. 19 is top perspective view of a modified comb for the hair brush of FIG. 12.
Figure 20:
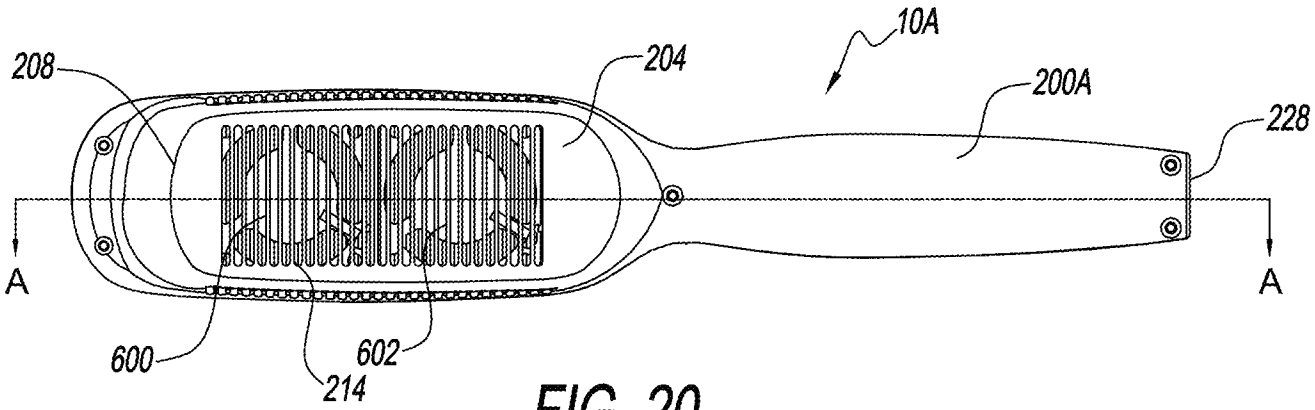
FIG. 20 is a bottom view of the hair brush of FIG. 12.
Figure 21:
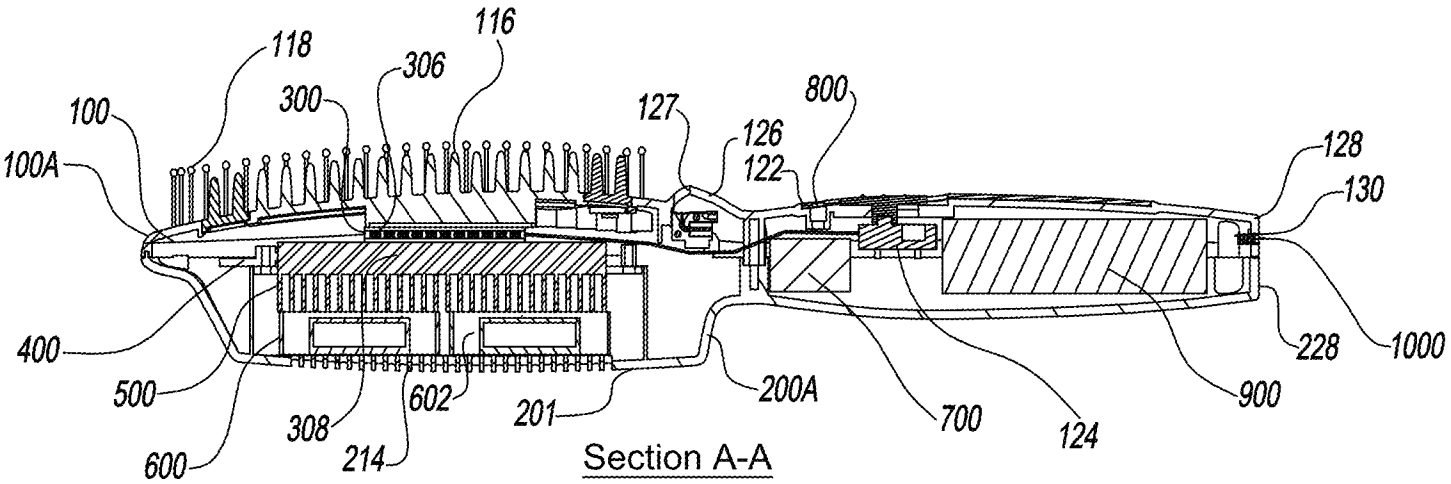
FIG. 21 is a side cross-sectional view of the hair brush of FIG. 12 taken along line A-A of FIG. 20.

Referring to FIG. 18, battery 900 has wires 902, 904 that connect to on/off switch 124. During operation, battery 900 supplies power to on/off switch 124 instead of power cord 18 of hair brush 10. Battery 900 can be a disposable battery or a rechargeable battery. Battery 900 is shown as a rechargeable battery that can be recharged by a USB cable that connects to outlet 1000 on a first end and a power source, e.g., electrical outlet, on a second end of the USB cable as is known in the art.

Hair brush 10, 10A described herein can be used on both wet and dry hair. Hair brush 10, 10A cools hair when brushed through the user's hair that can close the hair cuticles, thereby, trapping moisture and reducing frizziness and dryness, resulting in silkier, smoother hair. Accordingly, hair brush 10, 10A provides the advantages of cold temperature applied to hair and avoids the disadvantages of heat applied to hair when the user uses hair brush 10, 10A to brush through the user's hair.

While the present disclosure has been described with reference to one or more exemplary embodiments, it will be understood by those skilled in the art, that various changes can be made, and equivalents can be substituted for elements thereof without departing from the scope of the present disclosure. In addition, many modifications can be made to adapt a particular situation or material to the teachings of the present disclosure without departing from the scope thereof. Therefore, it is intended that the present disclosure will not be limited to the particular embodiments disclosed herein, but that the disclosure will include all aspects falling within the scope of a fair reading of appended claims.

What is claimed is:

1. A hair brush comprising:

a housing having a brush portion and a handle portion, the housing having a first end on the brush portion and a second end that is opposite the first end on the handle portion, the first end of the housing on the brush portion being closed;

a cooling device in the housing, the cooling device having a hot side and a cool side, and the hot side of the cooling device contacting a heat sink that is in the housing;

a comb having one or more teeth that extend from the brush portion of the housing, the comb having the one or more teeth being metallic or material that is thermally conductive, the comb is in direct physical contact with the cool side of the cooling device and is cooled when thermal energy in the form of heat is transferred by the cooling device in a direction away from the comb so that the cooling device cools the comb by thermal conduction, and the heat sink that is in the housing draws heat away from the comb;

one or more fan assemblies to remove the heat in the brush portion of the housing, the heat sink being between the cooling device and the one or more fan assemblies;

wherein the comb has a hair contacting surface;

wherein the hair contacting surface comprises the one or more teeth adapted to directly engage a user's hair, wherein the hair brush cools the user's hair only through thermal conduction by contact with the one or more teeth of the comb and/or the one or more teeth of the comb and the housing, wherein the housing has a first side and a second side that is opposite the first side, wherein the comb extends from the first side and the second side is free of bristles and teeth, wherein the housing has vents through the second side, wherein the first side of the brush portion is only cooled and the heat is released into the ambient air through the vents through the second side so that the one or more fan assemblies assist in moving heat away from the heat sink in an airflow and the vents release the airflow into the ambient air, and wherein the airflow is only on the hot side of the cooling device so that there is no airflow on the cool side of the cooling device.

2. The hair brush of claim 1, further comprising an ionizer in the housing.

3. The hair brush of claim 1, wherein the cooling device is connected to a plug.

4. The hair brush of claim 1, wherein the cooling device is connected to a battery.

5. The hair brush of claim 4, wherein the battery is connectable to a power source through a USB outlet.

6. The hair brush of claim 1, further comprising an opening in the housing, and a portion of the hair contacting surface extends through the opening.

7. The hair brush of claim 6, further comprising a plurality of bristles that extend from the housing to surround the hair contacting surface.

8. The hair brush of claim 6, wherein the comb is a first comb and further comprising a second comb, wherein the first comb and the second comb are each selectively connectable to the housing, and wherein the first comb and the second comb are interchangeably connectable to the housing.

9. The hair brush of claim 6, wherein the housing is metal, and wherein the cooling device cools the housing.

10. The hair brush of claim 6, wherein the one or more teeth of the comb form a central row of teeth centered between a U-shaped array of bristles, and wherein the teeth have a width dimension greater than a width of each of the bristles.

11. The hair brush of claim 1, wherein the teeth of the comb each have a half-oval shaped perimeter, and wherein the teeth of the comb each extend from a support that is in direct physical contact with the cool side of the cooling device.

* * * * *